US009642435B2

(12) United States Patent
Clements

(10) Patent No.: US 9,642,435 B2
(45) Date of Patent: May 9, 2017

(54) SHAVE-CADDY

(71) Applicant: Jon Lance Clements, Macedon, NY (US)

(72) Inventor: Jon Lance Clements, Macedon, NY (US)

( * ) Notice: Subject to any disclaimer, the term of this patent is extended or adjusted under 35 U.S.C. 154(b) by 0 days.

(21) Appl. No.: 14/166,050

(22) Filed: Jan. 28, 2014

(65) Prior Publication Data

US 2015/0208783 A1 Jul. 30, 2015

(51) Int. Cl.
*B65D 25/20* (2006.01)
*A45D 27/22* (2006.01)
*A45D 27/29* (2006.01)

(52) U.S. Cl.
CPC ..... *A45D 27/22* (2013.01); *A45D 27/29* (2013.01)

(58) Field of Classification Search
CPC ..... A45C 11/24; A45D 34/02
USPC ..... 220/636, 739; 206/228, 229, 581, 37
See application file for complete search history.

(56) References Cited

U.S. PATENT DOCUMENTS 4,856,647 A * 8/1989 Dahne ..... A45C 11/005 134/901
5,806,669 A * 9/1998 Kim ..... B65D 83/285 206/228
6,168,023 B1 * 1/2001 Cooper ..... A45D 27/22 132/290
2008/0237242 A1 * 10/2008 Gifford ..... A47G 23/0216 220/592.16
2009/0008270 A1 * 1/2009 Jones ..... A45D 34/02 206/37
2009/0101659 A1 * 4/2009 Morlan ..... A47G 23/032 220/592.16
2013/0020223 A1 * 1/2013 White ..... A47G 23/0233 206/459.5
2013/0334073 A1 * 12/2013 Frye ..... F42B 39/00 206/38
2014/0091099 A1 * 4/2014 Prchal ..... A47G 23/0216 220/592.17

* cited by examiner

*Primary Examiner* — King M Chu

(57) ABSTRACT

This invention is a dual cavity unit constructed in one of two different sizes to snugly store either a can of shaving cream or a can of shaving gel together with a manual shaving razor. Said invention is constructed primarily of neoprene or any other malleable material which has some amount of elasticity and is resistant to water, but not impervious. It is important to the invention that the material is resistant to the effects of water because it is intended to be used near water and in wet environments. It is also important that the material not be impervious to the effects of water in order to have planned obsolescence and generate repeat sales in the future. Further, the main advantage of this invention is the soft, pliable, and/or padded material used to construct it. The first cavity is a cylindrical tube which is open at the top and closed at the bottom and is constructed in one of two different sizes to snugly hold either a traditional can of shaving cream or a narrower can typically used to contain shaving gel. The second cavity is a "loop" which is open at the top, and can be either open or closed at the bottom, and is attached to the side of the first cavity using stitching, adhesive, or any other durable method of attachment of the two components.

1 Claim, 2 Drawing Sheets

SHAVE-CADDY

BACKGROUND OF THE INVENTION

Figure 1:
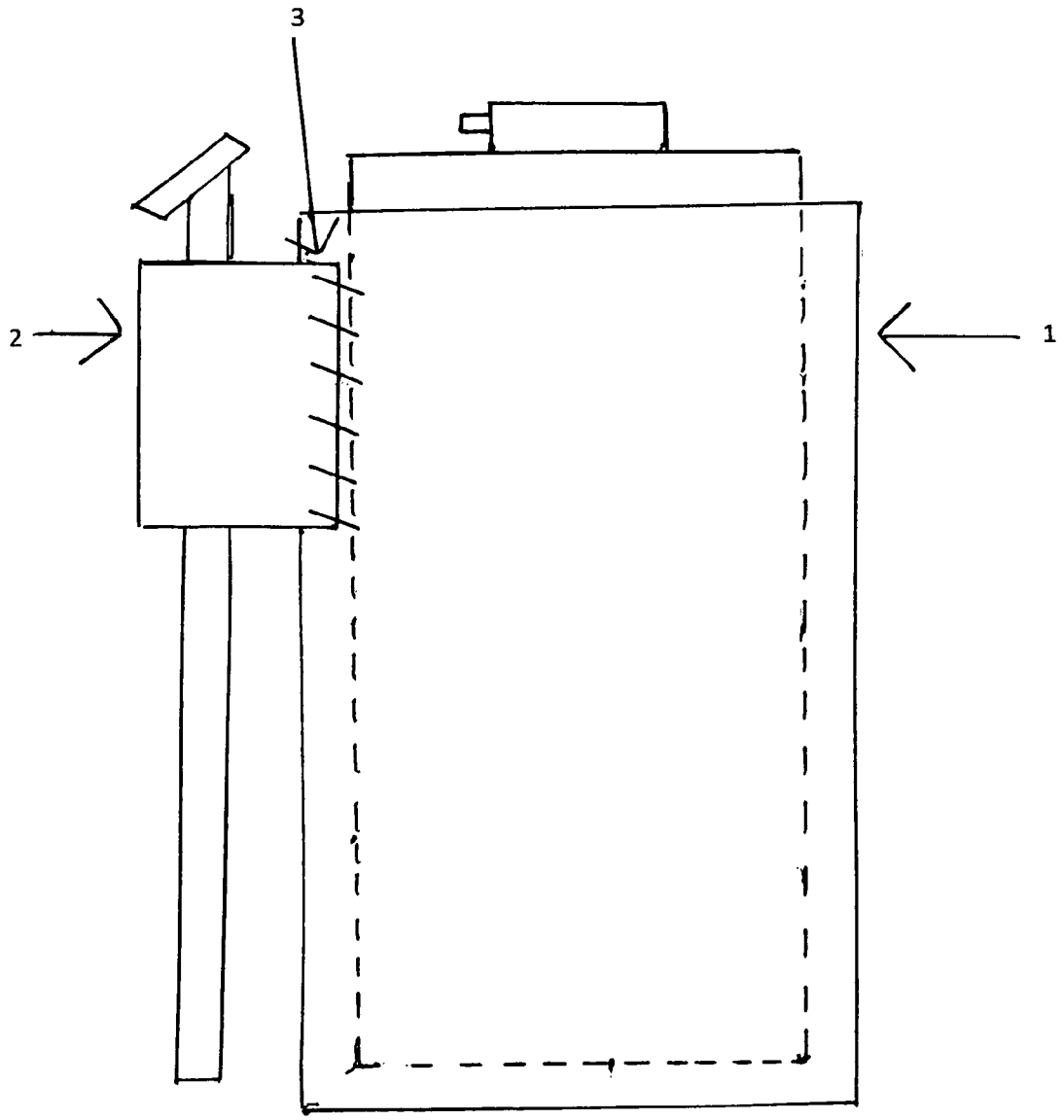

Ever since people have used razors to shave, there have been numerous accessories designed to hold the various shaving implements. Some of these accessories exist to hold the instruments together in one convenient place and others are designed to hold each implement separately in convenient locations. Prior inventions designed to store user's shaving cream, shaving gel and manual shaving utensils have been made from a variety of rigid, non-porous materials including, but not limited to ceramic, metal and plastic. These models have all failed to address multiple aesthetic or functionality defects which are remedied by using neoprene, which has some amount of elasticity an is resistant to water, but not impervious. Neoprene can be used to contain rust, which naturally occurs when a metallic container is exposed to water. The subject invention has a completely sealed bottom to prevent any rust from escaping the shave caddy and transferring to another surface Neoprene also has the ability to snugly hold on to user's container, thus reducing the vibrations which resonate sound in the event the can user's container is dropped. Neoprene provides a certain amount of cushioning that is both easier to grip when wet, and acts as a buffer between hard, sharp edges of a user's a container and vulnerable surfaces such as human flesh or easily marred surfaces that may exist. Neoprene is lightweight, easily portable, and can be produced inexpensively in a variety of different colors in order to accommodate consumer preferences and other aesthetic needs. Neoprene is typically attached using stitching, adhesive, or any other durable method of attachment of the two components. Said attachment can be inexpensively produced in a variety of different colors which can be used in concert with the different colors of neoprene to accommodate a more diverse variety of color combinations, meeting a variety of aesthetic needs. Neoprene is also able to be inexpensively embossed with logos, photographs, etc. which would meet aesthetic needs of the consumer.

SUMMARY OF THE INVENTION

This invention is a means of conveniently storing a user's container of shaving cream or shaving gel along with a user's manual shaving utensil. Although the concept has been around for several decades, said invention is novel because of the physical properties of neoprene, and the design of the invention itself. The unique properties of neoprene resolve multiple aesthetic and functionality issues that have not been addressed by prior versions of similar devices.

DETAILED DESCRIPTION OF THE INVENTION

This invention is a dual cavity unit constructed in one of two different sizes to snugly hold a user's container of shaving cream or shaving gel along with a user's manual shaving utensil. Said invention is constructed primarily of neoprene, which has some amount of elasticity and is resistant to water, but not impervious. The first cavity is a cylindrical tube which is open at the top and completely sealed at the bottom and is constructed in one of two different sizes to snugly hold either a user's traditional container of shaving cream or a narrower container typically used to contain shaving gel. The second cavity is a "loop" which is open at the top, open at the bottom, or open at the top and bottom, and is attached to the outside of the cylindrical tube using stitching, adhesive, or any other durable method of attachment of the two components.

BRIEF DESCRIPTION OF TH DRAWINGS

Figure 2:
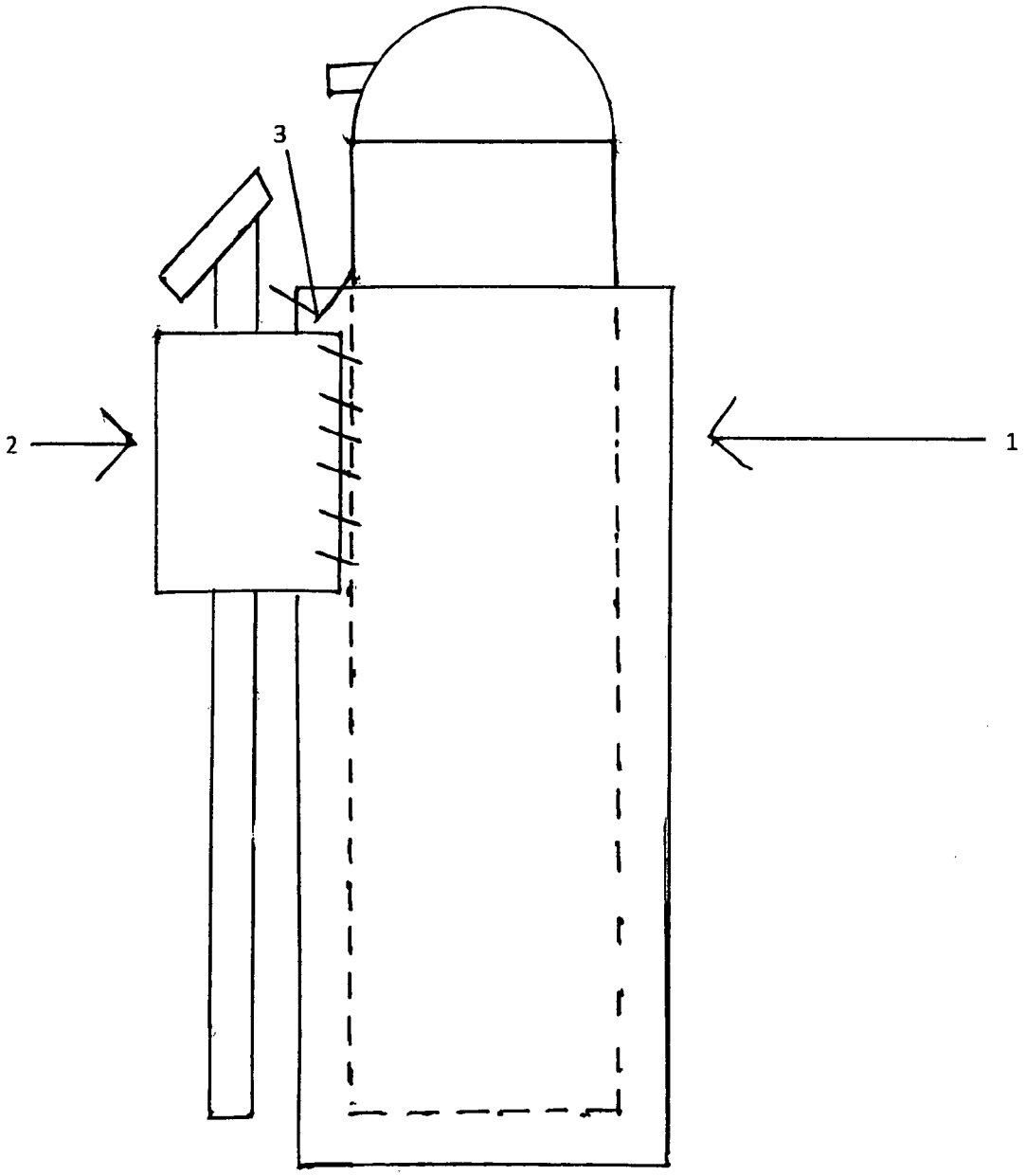

FIG. 1 illustrates a perspective view of the shave caddy designed to hold a user's traditional container of shaving cream FIG. 2 illustrates a perspective view of the shave caddy designed to hold a user's traditional container of shaving gel

DETAILED DESCRIPTION OF THE INVENTION

FIGS. 1-2 show a shave caddy is a single unit for holding either a user's container of shaving cream (FIG. 1) or a container of shaving gel (FIG. 2) with a user's manual shaving utensil. The shave caddy including a cylindrical body (1) with an open top and completely sealed bottom for holding said user's container of shaving cream or shaving gel. Attached to the outside of the cylindrical body (1) is a loop with an open top, open bottom, or open top and bottom (2) which is attached using stitching, adhesive, or any other durable method of attachment (3) and intended for the storage of a user's manual shaving utensil.

Patent Citations

| Cited Patent | Filing Date | Publication Date | Applicant | Title |
|---|---|---|---|---|
| US20090101659A1 | Dec. 31, 2008 | Apr. 23, 2009 | Jeffrey K Morlan | Multi-layer coaster and beverage container sleeve |
| US20090008270A1 | Jul. 3, 2008 | Jan. 8, 2009 | Monica Anne Jones | Personal care products storage caddy and usage apparatus |
| U.S. Pat. No. 2,022,508 | Sep. 27, 1934 | Nov. 26, 1935 | Edward Hoddersen | Shaving outfit |
| U.S. Pat. No. 2,949,203 | Dec. 22,1958 | Aug. 16, 1960 | Abbott Lab | Pilot tube |
| U.S. Pat. No. 3,272,323 | Nov. 3, 1964 | Sep. 13, 1966 | Avoset Company | Device for the securance of an article such as a safety razor to an aerosol container |
| U.S. Pat. No. 3,486,630 | Apr. 29, 1968 | Dec. 30, 1969 | Ellman Irving | A Shaving implement holder |
| U.S. Pat. No. 4,141,445 | Apr. 19, 1977 | Feb. 27, 1979 | Korich George P | Blade cartridge storage cap and razor holder |
| U.S. Pat. No. 4,320,832 | Aug. 6, 1979 | Mar. 23, 1982 | Richard Edstrom | Clip for holding safety razor |
| U.S. Pat. No. 4,656,738 | Aug. 1, 1985 | Apr. 14, 1987 | Corah Allan J | Razor holding means for shaving cream cans |

-continued

| Patent Citations | | | | |
|---|---|---|---|---|
| Cited Patent | Filing Date | Publication Date | Applicant | Title |
| U.S. Pat. No. 5,738,122 | May 3, 1995 | Apr. 14, 1998 | Armbruster; Joseph M. | Storage canister for shaving items |
| U.S. Pat. No. 5,806,669 | Oct. 16, 1996 | Sep. 15, 1998 | Kim; Paul | Razor support structures for containers |
| US 6168023B1 | Apr. 19, 1999 | Jan. 2, 2001 | Anthony M. Cooper | Caddy shaver receptacle for shaving items and instruments |
| US6179259B1 | Mar. 8, 1999 | Jan. 30, 2001 | Richard D. Schioldager | Razor Holder System |
| US20120103362 | Oct. 14, 2011 | May 3, 2012 | David Nowacek | Shaving product dispenser container with Mirror |

What is claimed:

1. A shave caddy comprising:

a cylindrical body having a completely sealed bottom, an open top, and a cylindrical body sidewall forming a first cavity; the cylindrical body made from a sheet of malleable material having elasticity and the malleable material is resistant to water and capable of containing rust from a user's can; the malleable material providing texture and grip for a user; the malleable material is also capable of reducing noise created when the user's can of shaving cream or shaving gel is dropped by deadening the vibrations which resonate sound inside and outside of the user's can; the malleable material acting as a buffer between hard, sharp edges of a can and vulnerable surfaces;

the cylindrical body is made to specifically receive a container of shaving cream or shaving gel in such a manner that the container fits snugly within the shave caddy; the cylindrical body having length-wise edges abutted and attached to one another by stitching, adhesive, or other methods of attachment;

a cylindrical loop with an open top, open bottom or open top and open bottom, and a loop sidewall forming a second cavity; the loop sidewall being attached to a top portion of the cylindrical body sidewall by stitching, adhesive, or other methods of attachment; the cylindrical loop being made to specifically receive and store all or part of a user's shaving utensil; the cylindrical loop and the cylindrical body being parallel and aligned to one another;

the stitching, adhesive or other methods of attachment joining the cylindrical body and the cylindrical loop having colors or different color combinations from the malleable material and the malleable material, the stitching, adhesive or other methods of attachment being embossed with indicia, logos, trademarks, or photographs in order to make the shave caddy more aesthetically pleasing to consumers.

* * * * *